US009719650B2

(12) United States Patent
Kinouchi

(10) Patent No.: US 9,719,650 B2
(45) Date of Patent: Aug. 1, 2017

(54) VEHICLE LAMP

(71) Applicant: KOITO MANUFACTURING CO., LTD., Tokyo (JP)

(72) Inventor: Toshiyuki Kinouchi, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 12 days.

(21) Appl. No.: 14/873,277

(22) Filed: Oct. 2, 2015

(65) Prior Publication Data

US 2016/0097505 A1 Apr. 7, 2016

(30) Foreign Application Priority Data

Oct. 7, 2014 (JP) ..... 2014-206172

(51) Int. Cl.
*F21S 8/10* (2006.01)
*F21Y 115/10* (2016.01)

(52) U.S. Cl.
CPC ..... *F21S 48/1376* (2013.01); *F21S 48/1159* (2013.01); *F21S 48/137* (2013.01); *F21S 48/1773* (2013.01); *F21Y 2115/10* (2016.08)

(58) Field of Classification Search
CPC .. F21S 48/1376; F21S 48/1773; F21S 48/137; F21S 48/1159; F21Y 2101/00
See application file for complete search history.

(56) References Cited

U.S. PATENT DOCUMENTS 6,457,849 B2 * 10/2002 Tsukamoto ..... F21S 48/1757 362/382
2009/0027912 A1 * 1/2009 Kondo ..... F21S 48/1154 362/538
2010/0165654 A1 * 7/2010 Okubo ..... F21S 48/1159 362/539
2010/0194276 A1 * 8/2010 Okubo ..... F21S 48/1159 315/82
2013/0027957 A1 * 1/2013 Okubo ..... F21S 48/1159 362/512
2013/0027958 A1 * 1/2013 Okubo ..... F21S 48/1159 362/512
2014/0307456 A1 * 10/2014 Ishida ..... B60Q 1/115 362/513
2014/0340922 A1 * 11/2014 Matsumoto ..... F21S 48/1109 362/516

(Continued)

FOREIGN PATENT DOCUMENTS

JP 4335621 B2 9/2009

*Primary Examiner* — Nimeshkumar Patel
*Assistant Examiner* — Jose M Diaz
(74) *Attorney, Agent, or Firm* — Sughrue Mion, PLLC

(57) ABSTRACT

A vehicle lamp includes a shade movable between a light blocking position and a light blocking release position. A light emitting surface of a light emitting element faces one side in a lateral direction and an upper end edge of the light emitting surface extends in a front-rear direction. A reflective surface of a reflector includes a first reflective area and a second reflective area. A low-beam light distribution pattern having a horizontal cut-off line and an oblique cut-off line is formed by a reflected light beam from the first reflective area when the shade is at the light blocking position, and a high-beam light distribution pattern is formed by the reflected light beams from the first reflective area and the second reflective area when the shade is at the light blocking release position.

4 Claims, 5 Drawing Sheets

(56) References Cited

U.S. PATENT DOCUMENTS

| | | | | |
|---|---|---|---|---|
| 2014/0340924 | A1* | 11/2014 | Matsumoto | F21S 48/1388<br>362/518 |
| 2016/0238210 | A1* | 8/2016 | Masuda | B60Q 1/0017 |

* cited by examiner

VEHICLE LAMP

The disclosure of Japanese Patent Application No. 2014-206172 filed on Oct. 7, 2014 including the specification, drawings and abstract is incorporated herein by reference in its entirety.

BACKGROUND OF THE INVENTION

1. Field of the Invention

The invention of this application relates to a vehicle lamp configured to selectively perform low beam irradiation and high beam irradiation.

2. Description of Related Art

Conventionally, a vehicle lamp configured to selectively perform low beam irradiation and high beam irradiation by reflecting a light beam from a light emitting element forward using a reflector is available.

Japanese Patent No. 4335621 describes such a vehicle lamp in which a low-beam light distribution pattern having horizontal and oblique cut-off lines is formed by the low beam irradiation.

In the vehicle lamp described in Japanese Patent No. 4335621, the horizontal cut-off line and the oblique cut-off line are formed by turning on separate light emitting elements at the time of the low beam irradiation, and another light emitting element is additionally turned on at the time of the high beam irradiation, and hence the cost of the vehicle lamp may be increased correspondingly to the additional light emitting element.

SUMMARY OF THE INVENTION

The invention of this application provides a vehicle lamp that is configured to selectively perform low beam irradiation and high beam irradiation by reflecting a light beam from a light emitting element forward using a reflector, and is capable of forming required light distribution patterns at a low cost.

An aspect of the invention relates to a vehicle lamp configured to selectively perform low beam irradiation and high beam irradiation, including: a light emitting element; a reflector that reflects an emitted light beam from the light emitting element forward; and a shade movable between a light blocking position at which a part of the emitted light beam traveling from the light emitting element to the reflector is blocked and a light blocking release position at which the light blocking is released. The light emitting element is disposed such that a light emitting surface of the light emitting element faces one side in a lateral direction and an upper end edge of the light emitting surface extends in a front-rear direction. A reflective surface of the reflector includes a first reflective area on which the emitted light beam from the light emitting element is incident, and a second reflective area on which the emitted light beam from the light emitting element is not incident when the shade is at the light blocking position. A low-beam light distribution pattern having a horizontal cut-off line and an oblique cut-off line is formed by a reflected light beam from the first reflective area when the shade is at the light blocking position, and a high-beam light distribution pattern is formed by the reflected light beam from the first reflective area and a reflected light beam from the second reflective area when the shade is at the light blocking release position.

As shown in the configuration described above, the vehicle lamp according to the invention forms the low-beam light distribution pattern having the horizontal and oblique cut-off lines by the reflected light beam from the first reflective area when the shade for blocking a part of the emitted light traveling from the light emitting element to the reflector is at the light blocking position, and forms the high-beam light distribution pattern by the reflected light beams from the first and second reflective areas when the shade moves to the light blocking release position. Hence, it is possible to selectively perform the low beam irradiation and the high beam irradiation using the single light emitting element.

By minimizing the number of required light emitting elements in this manner, it is possible to achieve a reduction in the cost of the lamp.

Thus, according to the invention, in the vehicle lamp configured to selectively perform the low beam irradiation and the high beam irradiation by reflecting the light beam from the light emitting element forward using the reflector, it is possible to form required light distribution patterns at a low cost.

The first reflective area may include a first sub-reflective area disposed at a position that intersects a horizontal plane including the upper end edge of the light emitting surface, and a second sub-reflective area disposed at a position that intersects an inclined plane including the upper end edge of the light emitting surface and inclined downward relative to the horizontal plane. In this case, the horizontal cut-off line may be formed by a reflected light beam from the first sub-reflective area and the oblique cut-off line may be formed by a reflected light beam from the second sub-reflective area.

When the light emitting surface of the light emitting element is viewed from the position of the first sub-reflective area, its upper end edge is recognized as a clear bright-dark boundary line, and hence, by forming the horizontal cut-off line by using the first sub-reflective area, it is possible to allow the horizontal cut-off line to have the clear cut-off line. Similarly, when the light emitting surface of the light emitting element is viewed from the position of the second sub-reflective area, its upper end edge is recognized as the clear bright-dark boundary line, and hence, by forming the oblique cut-off line by using the second sub-reflective area, it is possible to allow the oblique cut-off line to have the clear cut-off line.

The first reflective area may include a third sub-reflective area adjacent to the first sub-reflective area at a position above the first sub-reflective area, and a fourth sub-reflective area adjacent to the first sub-reflective area and the third sub-reflective area on another side in the lateral direction.

The light emitting surface of the light emitting element may have an outer shape that is longer in the front-rear direction than in an up-down direction. With the configuration described above, it is possible to secure the sufficient length of the upper end edge of the light emitting element and thus, it becomes possible to form the horizontal and oblique cut-off lines more clearly.

A position of a boundary line between the first reflective area and the second reflective area may be set at a position at which a plane including the upper end edge of the light emitting surface and a side end edge, on the one side in the lateral direction, of an upper end surface of the shade at the light blocking position intersects the reflective surface.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIGS. 5A and 5B are perspective views showing light distribution patterns formed by an irradiation light beam from the vehicle lamp, of which FIG. 5A shows a low-beam light distribution pattern and FIG. 5B shows a high-beam light distribution pattern.

DETAILED DESCRIPTION OF EMBODIMENTS

Hereinbelow, by using the drawings, an embodiment of the invention of the application will be described.

Figure 1:
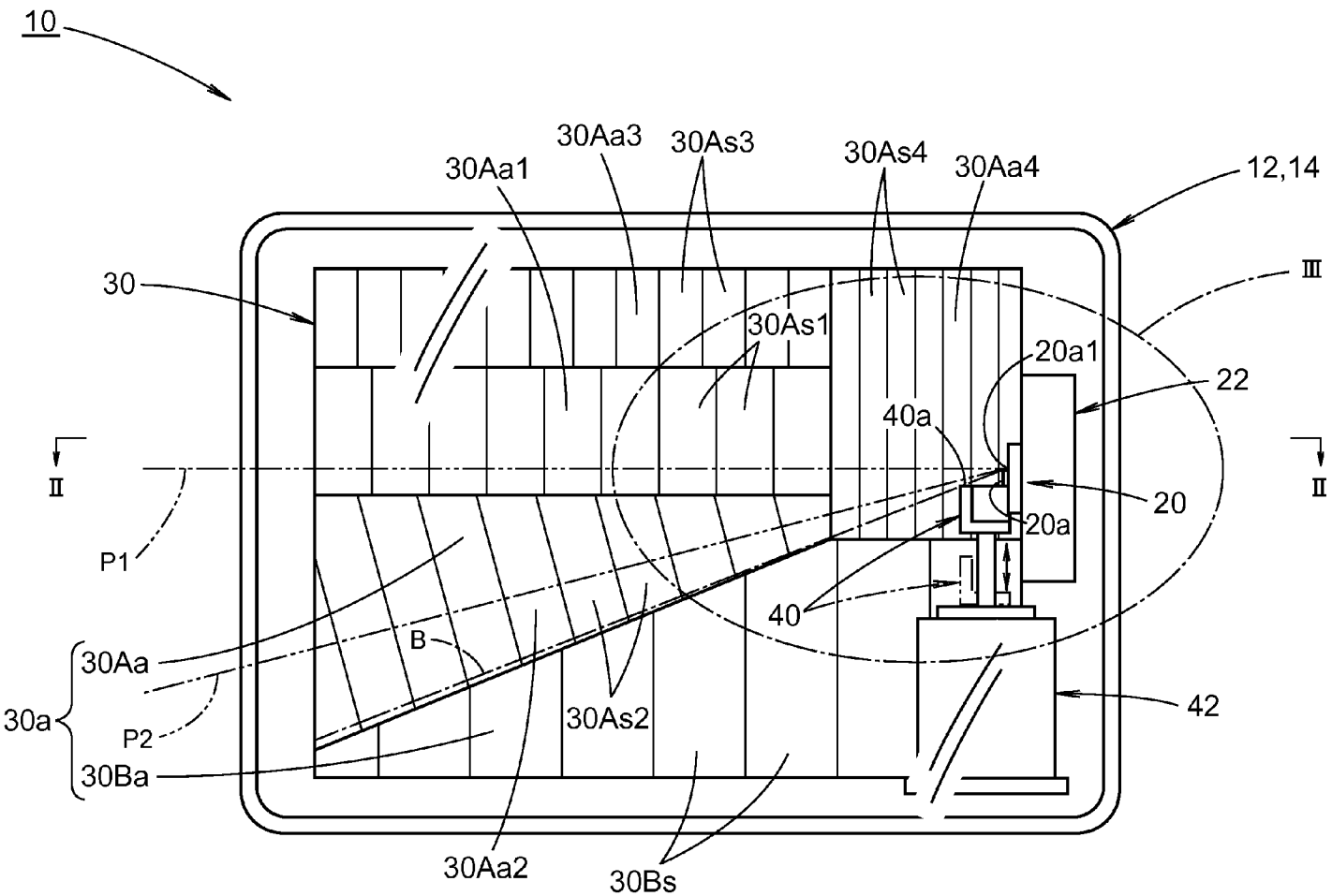
FIG. 1 is a front view showing a vehicle lamp according to an embodiment of the invention of the application.
Figure 2:
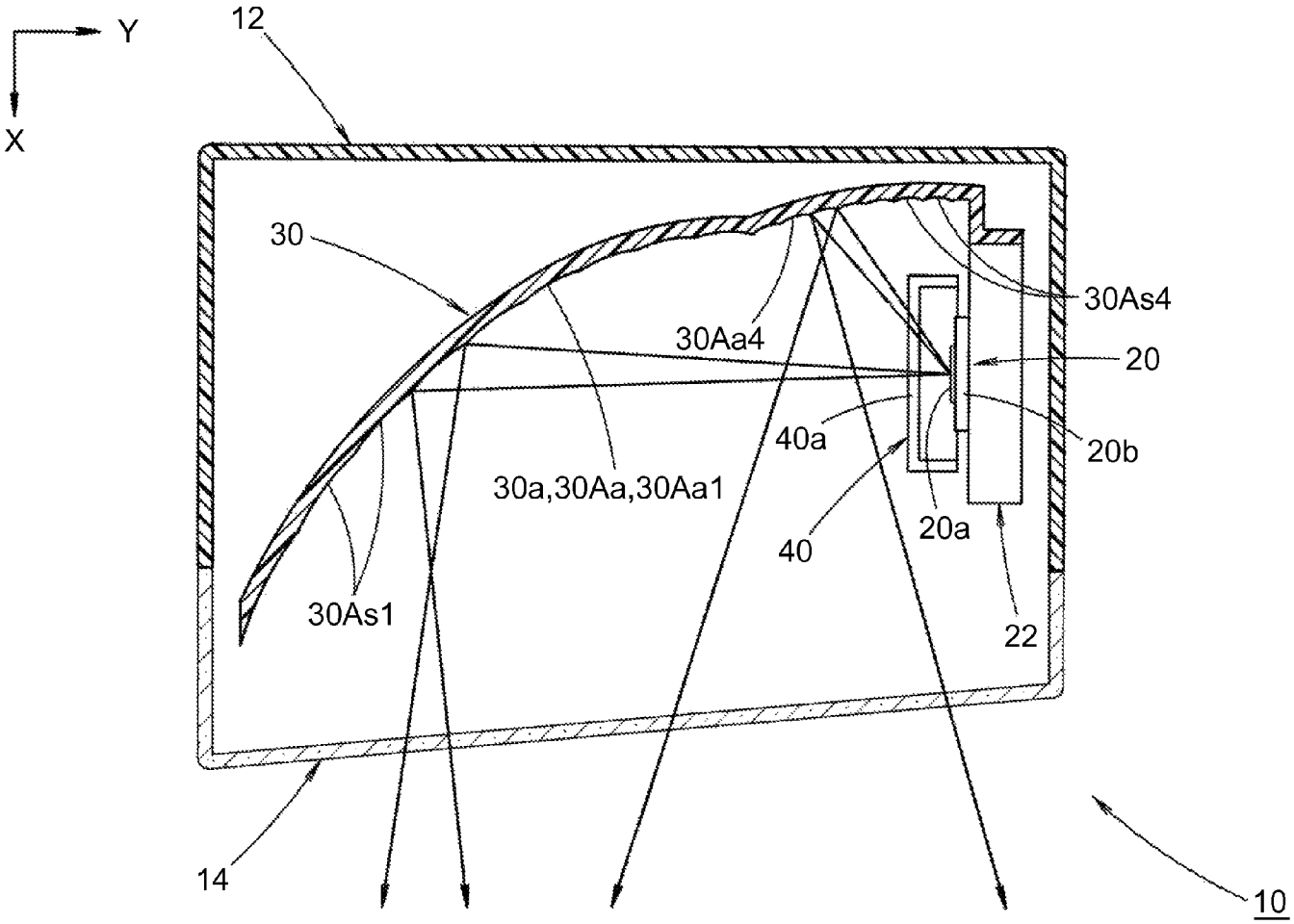
FIG. 2 is a sectional view taken along the line II-II of FIG. 1.

FIG. 1 is a front view showing a vehicle lamp 10 according to the embodiment of the invention of the application. FIG. 2 is a sectional view taken along the II-II of FIG. 1.

As shown in these drawings, the vehicle lamp 10 according to the embodiment is a head lamp disposed at a left front end portion of a vehicle, and is configured to selectively perform low beam irradiation and high beam irradiation.

For the vehicle lamp 10, a direction indicated by X in FIG. 2 is a "forward direction" (the "forward direction" for the vehicle), and a direction indicated by Y in FIG. 2 is a "left direction" orthogonal to the "forward direction" (the "left direction" for the vehicle but a "right direction" when the lamp is viewed from the front).

In the vehicle lamp 10, a light emitting element 20, a reflector 30 that reflects an emitted light beam from the light emitting element 20 forward, and a shade 40 for blocking a part of the emitted light beam traveling from the light emitting element 20 to the reflector 30 are disposed in a lamp chamber formed of a lamp body 12 and a transparent light-transmitting cover 14 attached to an opening portion of a front end of the lamp body 12.

The shade 40 is configured as a movable shade movable in an up-down direction between a light blocking position indicated by a solid line in FIG. 1 and a light blocking release position indicated by a two-dot chain line below the light blocking position. The specific configuration of the shade 40 will be described later.

The vehicle lamp 10 according to the embodiment forms a low-beam light distribution pattern having a horizontal cut-off line and an oblique cut-off line when the shade 40 is at the light blocking position, and form a high-beam light distribution pattern when the shade 40 moves to the light blocking release position.

Figure 3:
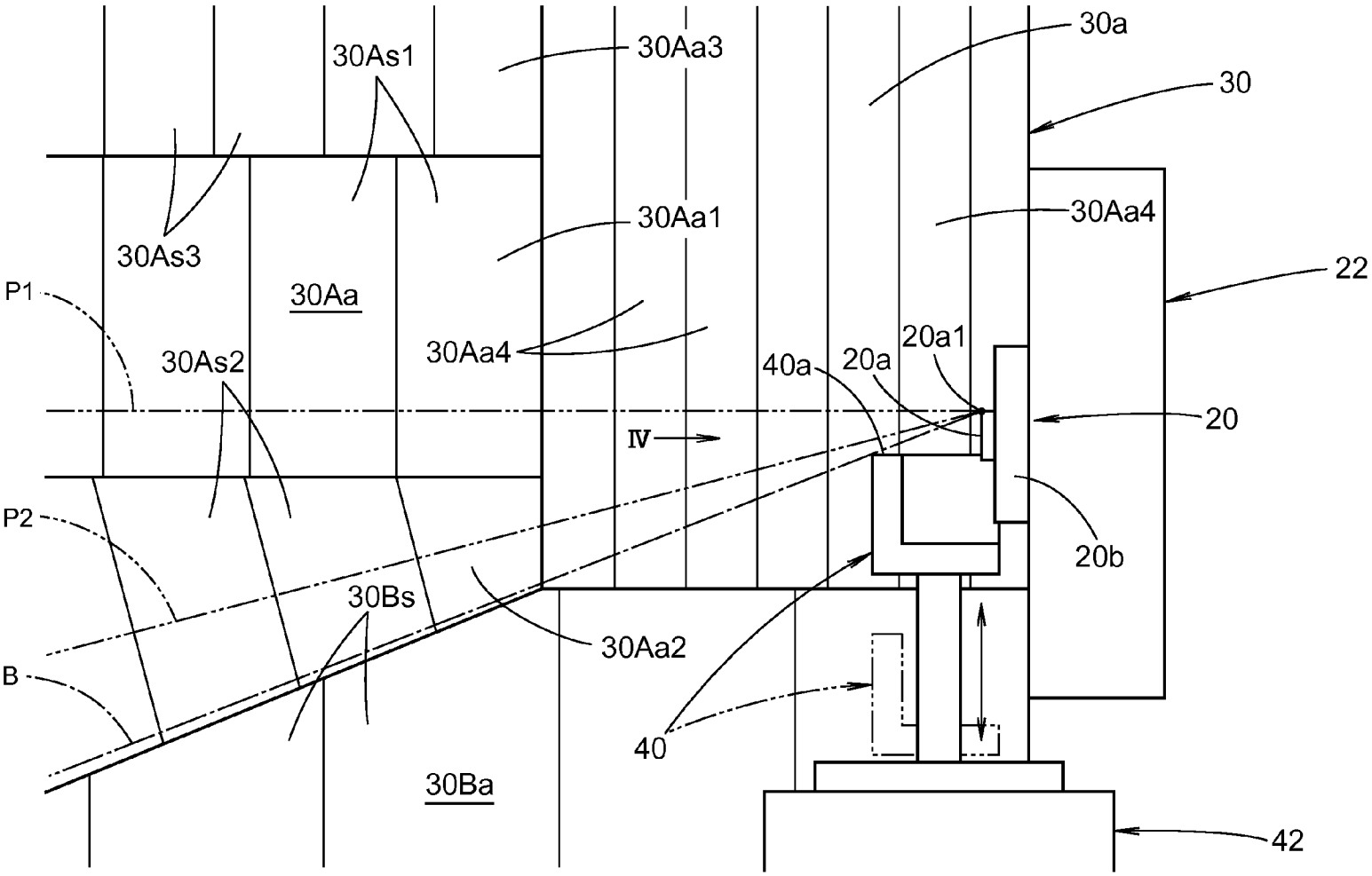
FIG. 3 is a detailed view of a III portion of FIG. 1.
Figure 4:
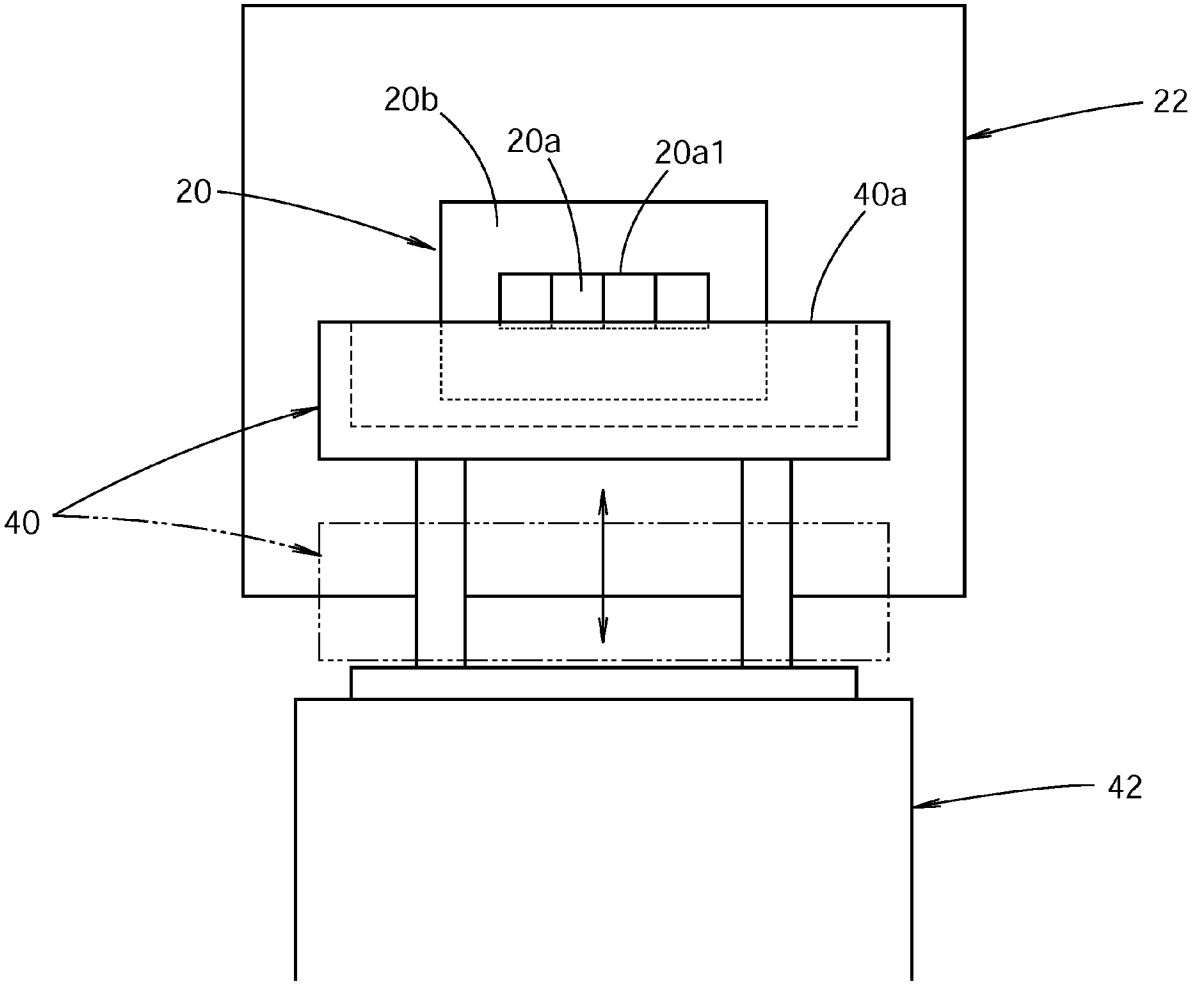
FIG. 4 is a view taken in a direction of an arrow IV of FIG. 3.

FIG. 3 is a detailed view of a III portion of FIG. 1. FIG. 4 is a view taken in a direction of an arrow IV of FIG. 3.

As shown in these drawings, the light emitting element 20 is a white light emitting diode, and has a rectangular light emitting surface 20*a* that elongates in a front-rear direction. In the light emitting surface 20*a*, the long side has a length more than twice (e.g., about four times) a length of the short side. Specifically, the light emitting surface 20*a* is configured such that four light emitting chips each having a square light emitting surface of which the side is about 1 mm are lined up side by side on a substrate 20*b*.

The light emitting element 20 is supported by a heat sink 22 at a left end portion in the lamp chamber (a "right end portion" when the lamp is viewed from the front) such that the light emitting surface 20*a* faces an inner side (i.e., a right side) in a vehicle width direction. The heat sink 22 is supported by the reflector 30.

The shade 40 is disposed at a position relatively close to the light emitting element 20 on the inner side in the vehicle width direction. The shade 40 is supported by a movement mechanism 42 disposed below the shade 40. The movement mechanism 42 is supported by the reflector 30.

The shade 40 is caused to move in the up-down direction between the light blocking position and the light blocking release position by driving the movement mechanism 42, as indicated by arrows in FIGS. 1, 3, and 4.

The shade 40 is formed so as to have an L-shaped cross section and extend in the front-rear direction. Horizontal portion of the shade 40 extends from a lower end position of a vertical portion of the shade 40 to an outer side in the vehicle width direction (i.e., a left side).

When the shade 40 is at the light blocking position, an upper end surface 40*a* of the vertical portion is positioned slightly above a lower end edge of the light emitting surface 20*a* of the light emitting element 20, and the horizontal portion is positioned slightly below the light emitting element 20.

The shade 40 extends to front and rear sides from front and rear end edges of the light emitting surface 20*a* of the light emitting element 20 to a certain degree. Vertical portions equal in height to the above vertical portion are formed at front and rear end portions of the shade 40. With this, when the shade 40 is at the light blocking position, a part of the emitted light beam traveling from the light emitting element 20 to the reflector 30 is blocked more reliably by the shade 40.

The reflector 30 is formed so as to extend forward from a position rearward of the light emitting element 20 to the inner side in the vehicle width direction, and has an oblong rectangular outer shape when the lamp is viewed from the front.

A reflective surface 30*a* of the reflector 30 is constituted by a first reflective area 30Aa and a second reflective area 30Ba positioned below the first reflective area 30Aa.

The first reflective area 30Aa is the area on which the emitted light beam from the light emitting element 20 is incident even when the shade 40 is at the light blocking position, and the second reflective area 30Ba is the area on which the emitted light beam from the light emitting element 20 is not incident when the shade 40 is at the light blocking position and on which the emitted light beam from the light emitting element 20 is incident when the shade 40 moves to the light blocking release position.

The position of a boundary line B between the first reflective area 30Aa and the second reflective area 30Ba is set to a position at which a plane including an upper end edge 20*a*1 of the light emitting surface 20*a* and a side end edge on the inner side in the vehicle width direction of the upper end surface 40*a* of the shade 40 at the light blocking position intersects the reflective surface 30*a*, as indicated by an alternate long and short dashed line in FIGS. 1 and 3. Specifically, the boundary line B extends in a direction inclined downward by about 20 to 25° (e.g., 22°) relative to a horizontal plane from the upper end edge 20*a*1 of the light emitting surface 20*a* when the lamp is viewed from the front. With this, all of a light beam reaching the reflective surface 30*a* from the light emitting element 20 when the shade 40 is at the light blocking position is reflected at the first reflective area 30Aa.

The first reflective area 30Aa includes a first sub-reflective area 30Aa1 for forming the horizontal cut-off line, and a second sub-reflective area 30Aa2 for forming the oblique cut-off line.

The first and second sub-reflective areas 30Aa1 and 30Aa2 are disposed so as to be adjacent to each other in the up-down direction with the first sub-reflective area 30Aa1 positioned above the second sub-reflective area 30Aa2. The first and second sub-reflective areas 30Aa1 and 30Aa2 are formed over a range from a position spaced apart from the shade 40 to the inner side in the vehicle width direction to a certain degree to an end edge position of the reflective surface 30*a* on the inner side in the vehicle width direction.

The first sub-reflective area 30Aa1 is disposed at a position that intersects a horizontal plane P1 (indicated by two-dot chain lines in FIGS. 1 and 3) including the upper end edge 20*a*1 of the light emitting surface 20*a* of the light emitting element 20. An upper end edge of the first sub-reflective area 30Aa1 is formed so as to extend in a horizontal direction to the inner side in the vehicle width direction at a position above the light emitting surface 20*a*, and its lower end edge is formed so as to extend in the horizontal direction to the inner side in the vehicle width direction at a position below the light emitting surface 20*a*.

The first sub-reflective area 30Aa1 is constituted by a plurality of reflective elements 30As1 that are separated from each other in a vertical stripe pattern when the lamp is viewed from the front. At the individual reflective elements 30As1, the emitted light beam from the light emitting element 20 is reflected forward as the light beam that is deflected slightly downward and diffused and/or deflected in the horizontal direction.

The second sub-reflective area 30Aa2 is disposed at a position that intersects an inclined plane P2 (indicated by two-dot chain lines in FIGS. 1 and 3) that includes the upper end edge 20*a*1 of the light emitting surface 20*a* of the light emitting element 20 and is inclined downward by 15° relative to the horizontal plane. An upper end edge of the second sub-reflective area 30Aa2 substantially matches the lower end edge of the first sub-reflective area 30Aa1, and a lower end edge of the second sub-reflective area 30Aa2 extends at a downward inclination angle that is slightly larger than that of the boundary line B at a position slightly below the boundary line B.

The second sub-reflective area 30Aa2 is constituted by a plurality of reflective elements 30As2 that are separated from each other in an oblique vertical stripe pattern in a direction orthogonal to the inclined plane P2 when the lamp is viewed from the front. At the individual reflective elements 30As2, the emitted light beam from the light emitting element 20 is reflected forward as the light beam that is deflected slightly downward and diffused and/or deflected in a direction along the inclined plane P2.

The first reflective area 30Aa includes a third sub-reflective area 30Aa3 adjacent to the first sub-reflective area 30Aa1 at a position above the first sub-reflective area 30Aa1, and a fourth sub-reflective area 30Aa4 adjacent to the first and third sub-reflective areas 30Aa1 and 30Aa3 on the left side thereof in addition to the first and second sub-reflective areas 30Aa1 and 30Aa2. A lower end edge of the fourth sub-reflective area 30Aa4 is formed so as to extend in the horizontal direction from a lower end position of a left end edge of the second sub-reflective area 30Aa2 to the outer side in the vehicle width direction.

The third sub-reflective area 30Aa3 is constituted by a plurality of reflective elements 30As3 that are separated from each other in the vertical stripe pattern when the lamp is viewed from the front. At the individual reflective elements 30As3, the emitted light beam from the light emitting element 20 is reflected forward as the light beam that is deflected downward to a certain degree and diffused in the horizontal direction relatively greatly.

The fourth sub-reflective area 30Aa4 is constituted by a plurality of reflective elements 30As4 that are separated from each other in the vertical stripe pattern when the lamp is viewed from the front. At the individual reflective elements 30As4, the emitted light beam from the light emitting element 20 is reflected forward as the light beam that is deflected downward to a certain degree and diffused in the horizontal direction greatly.

On the other hand, as described above, the second reflective area 30Ba is the area on which the emitted light beam from the light emitting element 20 is incident when the shade 40 moves to the light blocking release position, and most of the second reflective area 30Ba is constituted by a plurality of reflective elements 30Bs that are separated from each other in the vertical stripe pattern when the lamp is viewed from the front. At the individual reflective elements 30Bs, the emitted light beam from the light emitting element 20 is reflected forward as the light beam that is slightly diffused in the horizontal direction.

Figure 5A:
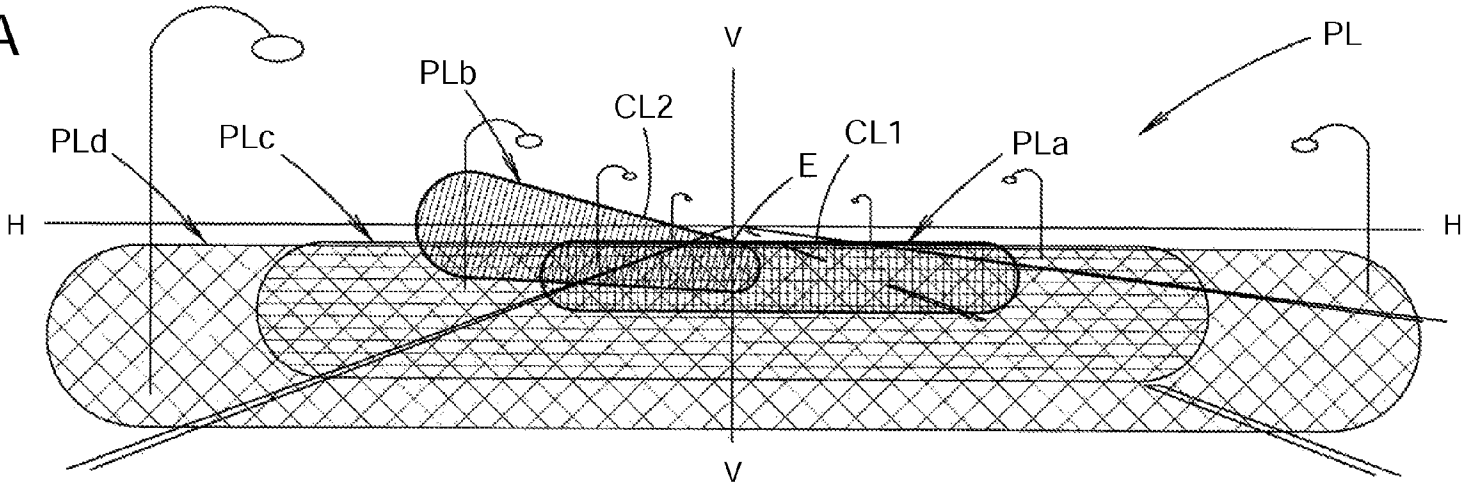
Figure 5B:
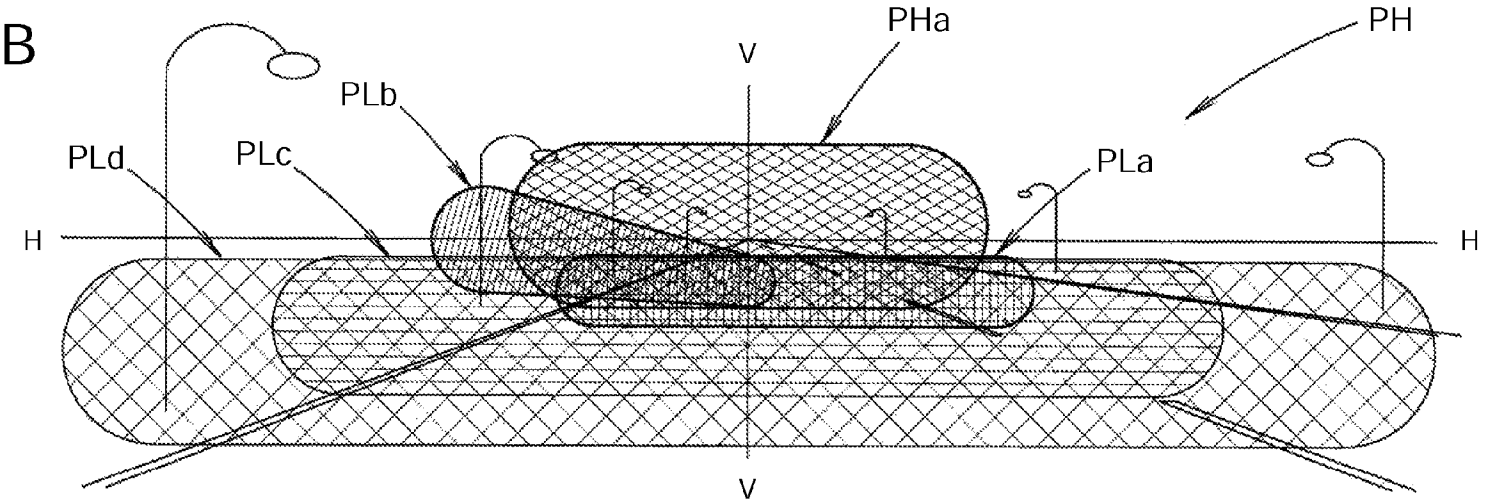

FIGS. 5A and 5B are perspective views showing light distribution patterns formed on a virtual vertical screen disposed at a position 25 m forward of the lamp by the light beam projected forward from the vehicle lamp 10. The light distribution pattern shown in FIG. 5A is the low-beam light distribution pattern, and the light distribution pattern shown in FIG. 5B is the high-beam light distribution pattern.

A low-beam light distribution pattern PL shown in FIG. 5A is the light distribution pattern of left light distribution, and has cut-off lines CL1 and CL2 at its upper end edge. With regard to the cut-off lines CL1 and CL2, an opposite lane-side portion on the right side of a V-V line that vertically passes through H-V as a vanishing point in the forward direction of the lamp is formed as the horizontal cut-off line CL1, and a driving lane-side portion on the left side of the V-V line is formed as the oblique cut-off line CL2.

In the low-beam light distribution pattern PL, an elbow point E as a point of intersection between the horizontal cut-off line CL1 and the oblique cut-off line CL2 is positioned about 0.5 to 0.6° below the vanishing point H-V.

The low-beam light distribution pattern PL is formed as a combination light distribution pattern of four light distribution patterns PLa, PLb, PLc, and PLd formed by a reflected light beam from the first reflective area 30Aa.

The light distribution pattern PLa is the light distribution pattern formed by the reflected light beam from the first sub-reflective area 30Aa1.

The light distribution pattern PLa is the oblong light distribution pattern that extends in the horizontal direction to the right side of the V-V line from a position on the left side of the V-V line, and is formed as the bright light distribution pattern having a narrow width in the up-down direction. The light distribution pattern PLa forms the clear horizontal cut-off line CL1 at its upper end edge.

The light distribution pattern PLa is formed as the light distribution pattern having the clear horizontal cut-off line CL1 at the upper end edge because the first sub-reflective area 30Aa1 is disposed at the position that intersects the horizontal plane P1 including the upper end edge 20*a*1 of the light emitting surface 20*a*.

The light distribution pattern PLa is formed as the bright light distribution pattern having the narrow width in the up-down direction because the light emitting element 20 has the light emitting surface 20*a* that is long in the front-rear direction, and the first sub-reflective area 30Aa1 is positioned in a direction close to the direction of the normal to the light emitting surface 20*a*.

The light distribution pattern PLb is the light distribution pattern formed by the reflected light beam from the second sub-reflective area 30Aa2.

The light distribution pattern PLb is the oblong light distribution pattern that spreads obliquely upward in a fan shape from a position slightly on the right side of the V-V line to the left side of the V-V line, is formed as the bright light distribution pattern. The light distribution pattern PLb forms the clear oblique cut-off line CL2 that is inclined at an inclination angle of 15° relative to the horizontal plane at its upper end edge.

The light distribution pattern PLb is formed as the light distribution pattern having the clear horizontal cut-off line CL2 at the upper end edge because the second sub-reflective area 30Aa2 is disposed at the position that intersects the inclined plane P2 including the upper end edge 20*a*1 of the light emitting surface 20*a*.

The light distribution pattern PLb is formed as the bright light distribution pattern because the light emitting element 20 has the light emitting surface 20*a* that is long in the front-rear direction, and the second sub-reflective area 30Aa2 is positioned in a direction relatively close to the direction of the normal to the light emitting surface 20*a*.

The light distribution pattern PLc is the light distribution pattern formed by the reflected light beam from the third sub-reflective area 30Aa3, and is formed as the oblong light distribution pattern that spreads relatively widely to the left and the right with the V-V line positioned at the center at a position below the horizontal cut-off line CL1.

The light distribution pattern PLc is formed as the light distribution pattern having the width in the up-down direction larger than that of the light distribution pattern PLa because the third sub-reflective area 30Aa3 is positioned in a direction inclined to some extent from the direction of the normal to the light emitting surface 20*a* that elongates in the front-rear direction.

The light distribution pattern PLd is the light distribution pattern formed by the reflected light beam from the fourth sub-reflective area 30Aa4, and is formed as the oblong light distribution pattern that spreads widely to the left and the right with the V-V line positioned at the center at a position below the horizontal cut-off line CL1.

The light distribution pattern PLd is formed as the light distribution pattern having the width in the up-down direction larger than that of the light distribution pattern PLc because the fourth sub-reflective area 30Aa4 includes an area positioned in a direction inclined at an angle larger than that of the third sub-reflective area 30Aa3 from the direction of the normal to the light emitting surface 20*a* that elongates in the front-rear direction.

A high-beam light distribution pattern PH shown in FIG. 5B is formed as the light distribution pattern in which a light distribution pattern PHa is superimposed on the four light distribution patterns PLa to PLd constituting the low-beam light distribution pattern PL.

The light distribution pattern PHa is the light distribution pattern formed by the reflected light beam from the second reflective area 30Ba, and is formed as the slightly oblong light distribution pattern with the vanishing point H-V positioned at its center. The light distribution pattern PHa is formed as the bright light distribution pattern having a spot shape.

The light distribution pattern PHa is formed at the position of the vanishing point H-V so as to be superimposed on the four light distribution patterns PLa to PLd, and the high-beam light distribution pattern PH thereby becomes the light distribution pattern excellent in long distance visibility in which an area in the vicinity of the vanishing point H-V is bright.

Next, the operation and effect of this embodiment will be described.

The vehicle lamp 10 according to the embodiment forms the low-beam light distribution pattern PL having the horizontal and oblique cut-off lines CL1 and CL2 by the reflected light beam from the first reflective area 30Aa when the shade 40 for blocking a part of the emitted light beam traveling from the light emitting element 20 to the reflector 30 is at the light blocking position, and forms the high-beam light distribution pattern PH by the reflected light beams from the first and second reflective areas 30Aa and 30Ba when the shade 40 moves to the light blocking release position. Hence, it is possible to selectively perform the low beam irradiation and the high beam irradiation using the single light emitting element 20.

By minimizing the number of required light emitting elements 20 in this manner, it is possible to achieve a reduction in the cost of the lamp.

Thus, according to the embodiment, in the vehicle lamp 10 configured to selectively perform the low beam irradiation and the high beam irradiation by reflecting the light beam from the light emitting element 20 forward using the reflector 30, it is possible to form required light distribution patterns at a low cost.

In addition, in the embodiment, the first reflective area 30Aa includes the first sub-reflective area 30Aa1 disposed at the position that intersects the horizontal plane P1 including the upper end edge 20*a*1 of the light emitting surface 20*a* of the light emitting element 20, and the second sub-reflective area 30Aa2 disposed at the position that intersects the inclined plane P2 including the upper end edge 20*a*1 and inclined downward relative to the horizontal plane, and the horizontal cut-off line CL1 is formed by the reflected light beam from the first sub-reflective area 30Aa1 and the oblique cut-off line CL2 is formed by the reflected light beam from the second sub-reflective area 30Aa2. With this, it is possible to obtain the following operation and effect.

When the light emitting surface 20*a* of the light emitting element 20 is viewed from the position of the first sub-reflective area 30Aa1, the upper end edge 20*a*1 is recognized as a clear bright-dark boundary line, and hence, by forming the horizontal cut-off line CL1 by using the first sub-reflective area 30Aa1, it is possible to allow the horizontal cut-off line CL1 to have the clear cut-off line. Similarly, when the light emitting surface 20*a* of the light emitting element 20 is viewed from the position of the second sub-reflective area 30Aa2, the upper end edge 20*a*1 is recognized as the clear bright-dark boundary line, and hence, by forming the oblique cut-off line CL2 by using the second sub-reflective area 30Aa2, it is possible to allow the oblique cut-off line CL2 to have the clear cut-off line.

Further, in the embodiment, the light emitting element 20 has the outer shape having the light emitting surface that is longer in the front-rear direction than in the up-down direction. Hence, it is possible to secure the sufficient length of the upper end edge 20*a*1 and, with this, it becomes possible to form the horizontal and oblique cut-off lines CL1 and CL2 more clearly.

In the above embodiment, the description has been given on the configuration in which the shade 40 is formed so as to have the L-shaped cross section and extend in the front-rear direction, but it is also possible to adopt a configuration in which the shade 40 has a shape other than the above shape.

In addition, in the above embodiment, the description has been given on the configuration in which the shade 40 is caused to move in the up-down direction by driving the movement mechanism 42, but it is also possible to adopt a configuration in which a movement other than the above movement (e.g., a movement in the front-rear direction or rotation) is performed.

In the above embodiment, the description has been given on the vehicle lamp 10 configured to form the low-beam light distribution pattern PL of the left light distribution but, by adopting a configuration in which the vehicle lamp 10 according to the embodiment is inverted in a left and right direction, it is also possible to configure the vehicle lamp 10 such that the low-beam light distribution pattern of right light distribution is formed.

Note that the numeric values shown as the specifications of the vehicle lamp in the above embodiment are only examples and these numeric values may be set to different values as required.

In addition, the invention is not limited to the configuration described in the above embodiment, and the embodiment of the invention may adopt a configuration in which other various changes are made.

As described above, the vehicle lamp according to the invention is configured to selectively perform low beam irradiation and high beam irradiation, and includes: a light emitting element; a reflector that reflects an emitted light beam from the light emitting element forward; and a shade movable between a light blocking position at which a part of the emitted light beam traveling from the light emitting element to the reflector is blocked and a light blocking release position at which the light blocking is released. The light emitting element is disposed such that a light emitting surface of the light emitting element faces one side in a lateral direction and an upper end edge of the light emitting surface extends in a front-rear direction. A reflective surface of the reflector includes a first reflective area on which the emitted light beam from the light emitting element is incident, and a second reflective area on which the emitted light beam from the light emitting element is not incident when the shade is at the light blocking position. A low-beam light distribution pattern having a horizontal cut-off line and an oblique cut-off line is formed by a reflected light beam from the first reflective area when the shade is at the light blocking position, and a high-beam light distribution pattern is formed by the reflected light beam from the first reflective area and a reflected light beam from the second reflective area when the shade is at the light blocking release position.

The type of the light emitting element mentioned above is not particularly limited, and it is possible to use, e.g., a light emitting diode and a laser diode.

The specific positional relationship between the first reflective area and the second reflective area mentioned above is not particularly limited.

The first reflective area mentioned above is configured to form the low-beam light distribution pattern having the horizontal and oblique cut-off lines by reflecting the emitted light beam from the light emitting element, and a specific reflective surface shape thereof is not particularly limited.

The shade mentioned above is configured to move between the light blocking position and the light blocking release position, and a specific movement mode is not particularly limited.

What is claimed is:

1. A vehicle lamp configured to selectively perform low beam irradiation and high beam irradiation, comprising:

a light emitting element;

a reflector that reflects an emitted light beam from the light emitting element forward; and a shade movable between a light blocking position at which a part of the emitted light beam traveling from the light emitting element to the reflector is blocked and a light blocking release position at which the light blocking is released, wherein:

the light emitting element is disposed such that a light emitting surface of the light emitting element faces one side in a lateral direction and an upper end edge of the light emitting surface extends in a front-rear direction;

a reflective surface of the reflector includes a first reflective area on which the emitted light beam from the light emitting element is incident, and a second reflective area on which the emitted light beam from the light emitting element is not incident when the shade is at the light blocking position; and a low-beam light distribution pattern having a horizontal cut-off line and an oblique cut-off line is formed by a reflected light beam from the first reflective area when the shade is at the light blocking position, and a high-beam light distribution pattern is formed by the reflected light beam from the first reflective area and a reflected light beam from the second reflective area when the shade is at the light blocking release position, wherein:

the first reflective area includes a first sub-reflective area disposed at a position that intersects a horizontal plane including the upper end edge of the light emitting surface, and a second sub-reflective area disposed at a position that intersects an inclined plane including the upper end edge of the light emitting surface and inclined downward relative to the horizontal plane; and the horizontal cut-off line is formed by a reflected light beam from the first sub-reflective area and the oblique cut-off line is formed by a reflected light beam from the second sub-reflective area.

2. The vehicle lamp according to claim 1, wherein the first reflective area includes a third sub-reflective area adjacent to the first sub-reflective area at a position above the first sub-reflective area, and a fourth sub-reflective area adjacent to the first sub-reflective area and the third sub-reflective area on another side in the lateral direction.

3. The vehicle lamp according to claim 1, wherein the light emitting surface of the light emitting element has an outer shape that is longer in the front-rear direction than in an up-down direction.

4. A vehicle lamp configured to selectively perform low beam irradiation and high beam irradiation, comprising:

a light emitting element;

a reflector that reflects an emitted light beam from the light emitting element forward; and a shade movable between a light blocking position at which a part of the emitted light beam traveling from the light emitting element to the reflector is blocked and a light blocking release position at which the light blocking is released, wherein:

the light emitting element is disposed such that a light emitting surface of the light emitting element faces one side in a lateral direction and an upper end edge of the light emitting surface extends in a front-rear direction;

a reflective surface of the reflector includes a first reflective area on which the emitted light beam from the light emitting element is incident, and a second reflective area on which the emitted light beam from the light emitting element is not incident when the shade is at the light blocking position; and a low-beam light distribution pattern having a horizontal cut-off line and an oblique cut-off line is formed by a reflected light beam from the first reflective area when the shade is at the light blocking position, and a high-beam light distribution pattern is formed by the reflected light beam from the first reflective area and a reflected light beam from the second reflective area when the shade is at the light blocking release position, wherein a position of a boundary line between the first reflective area and the second reflective area is set at a position at which a plane including the upper end edge of the light emitting surface and a side end edge, on the one side in the lateral direction, of an upper end surface of the shade at the light blocking position intersects the reflective surface.

* * * * *